US008562766B2

(12) United States Patent
Blejde et al.

(10) Patent No.: US 8,562,766 B2
(45) Date of Patent: Oct. 22, 2013

(54) METHOD FOR MAKING A LOW SURFACE ROUGHNESS CAST STRIP

(75) Inventors: Walter N. Blejde, Brownsburg, IN (US); Jay Jon Ondrovic, Brownsburg, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 13/215,388

(22) Filed: Aug. 23, 2011

(65) Prior Publication Data

US 2011/0303386 A1 Dec. 15, 2011

Related U.S. Application Data

(63) Continuation-in-part of application No. 12/272,207, filed on Nov. 17, 2008, now abandoned, which is a continuation of application No. 11/362,682, filed on Feb. 27, 2006, now abandoned.

(51) Int. Cl.
*C21D 7/13* (2006.01)
*C22C 33/04* (2006.01)

(52) U.S. Cl.
USPC ..... 148/541; 148/546; 148/648; 148/654; 164/476

(58) Field of Classification Search
USPC ..... 148/541, 546, 648, 654; 164/475, 476, 164/480
See application file for complete search history.

(56) References Cited

U.S. PATENT DOCUMENTS

| | | | |
|---|---|---|---|
| 4,589,470 | A | 5/1986 | Bedell et al. |
| 4,671,091 | A | 6/1987 | Atack et al. |
| 4,765,390 | A | 8/1988 | Vaterlaus |
| 4,793,401 | A | 12/1988 | Matsuoka et al. |
| 4,815,519 | A | 3/1989 | Chielens |
| 5,058,656 | A | 10/1991 | Hoffken et al. |
| 5,634,512 | A | 6/1997 | Bombardelli et al. |
| 5,762,126 | A | 6/1998 | Assefpour-Dezfully et al. |
| 5,901,777 | A | 5/1999 | Matsumura et al. |

(Continued)

FOREIGN PATENT DOCUMENTS

| | | |
|---|---|---|
| EP | 732163 | 9/1996 |
| JP | 08-300108 | 11/1996 |

(Continued)

OTHER PUBLICATIONS

Machine-English translation of Japanese patent 2000-351002, Hiruta Toshiki et al., Dec. 19, 2000.*

(Continued)

*Primary Examiner* — Deborah Yee
(74) *Attorney, Agent, or Firm* — Hahn, Loeser & Park LLP; Arland T. Stein

(57) ABSTRACT

A thin cast strip is formed having at least one microstructure selected from the group consisting of polygonal ferrite, acicular ferrite, Widmanstatten, bainite and martinsite, a surface roughness of less than 1.5 microns Ra and a scale thickness of less than about 10 microns by applying a mixture of water and oil on the work rolls of the hot rolling mill, passing the thin cast strip at a temperature of less than 1100° C. through the hot rolling mill while the mixture of oil and water is applied to the work rolls, and shrouding the thin cast strip from the casting rolls through the hot rolling mill in an atmosphere of less than 5% oxygen to form the thin cast strip.

33 Claims, 6 Drawing Sheets

(56) References Cited

U.S. PATENT DOCUMENTS

| | | | |
|---|---|---|---|
| 6,273,178 | B1 | 8/2001 | Osada et al. |
| 6,374,901 | B1 | 4/2002 | Frank et al. |
| 6,585,030 | B2 | 7/2003 | Strezov et al. |
| 6,776,218 | B2 | 8/2004 | Glutz et al. |
| 6,920,912 | B2 | 7/2005 | Blejde et al. |
| 7,159,433 | B2 | 1/2007 | Seidel |
| 7,181,822 | B2 | 2/2007 | Ondrovic et al. |
| 7,216,693 | B2 | 5/2007 | Kapaj et al. |
| 2002/0043357 | A1 | 4/2002 | Strezov et al. |
| 2004/0144518 | A1 | 7/2004 | Blejde et al. |

FOREIGN PATENT DOCUMENTS

| | | |
|---|---|---|
| JP | 09-137249 | 5/1997 |
| JP | 2000-061588 | 2/2000 |
| JP | 2000-0351002 | 12/2000 |
| JP | 2004-508942 | 3/2004 |
| JP | 2006-272418 | 10/2006 |

OTHER PUBLICATIONS

International Search Report for PCT/AU2007/000227, Apr. 27, 2007.

Written Opinion for PCT/AU2007/000227, Apr. 27, 2007.

Blejde, Walter et al., "Development of Low Carbon Thin Strip Production Capability at Project 'M'", Iron & Steelmaker, vol. 27, No. 4, 2000, pp. 29-36.

Mukunthan, K. et al., "Evolution of microstructures and product opportunities in low carbon steel strip casting" Canadian Metallurgical Quarterly, vol. 40, No. 4, Oct. 2001, pp. 523-539.

Machine translation of JP 2006-272418.

* cited by examiner

METHOD FOR MAKING A LOW SURFACE ROUGHNESS CAST STRIP

CROSS-REFERENCE TO RELATED APPLICATIONS

This application is a continuation-in-part of U.S. patent application No. 12/272,207 filed Nov. 17, 2008 now abandoned, which is a continuation of U.S. patent application Ser. No. 11/362,682 filed Feb. 27, 2006 now abandoned, the disclosures of which are incorporated herein by reference.

BACKGROUND AND SUMMARY OF THE INVENTION

This invention relates to cast strip made by a twin roll caster, and the method and apparatus for making such cast strip.

In a twin roll caster, molten metal is introduced between a pair of counter-rotated horizontal casting rolls which are cooled so that metal shells solidify on the moving roll surfaces, and are brought together at the nip between them to produce a solidified strip product delivered downwardly from the nip between the casting rolls.

The term "nip" is used herein to refer to the general region at which the casting rolls are closest together. The molten metal may be poured from a ladle through a metal delivery system comprised of a tundish and a core nozzle located above the nip to form a casting pool of molten metal supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

When casting steel strip in a twin roll caster, the strip leaves the nip at very high temperatures on the order of 1400° C. or higher. If exposed to normal atmosphere, it would suffer very rapid scaling due to oxidation at such high temperatures. Therefore, a sealed enclosure is provided beneath the casting rolls to receive the hot strip and through which the strip passes on the way from the strip caster, the enclosure containing an atmosphere which inhibits oxidation of the strip. The oxidation inhibiting atmosphere may be created by injecting a non-oxidizing gas, for example, an inert gas such as argon or nitrogen, or combustion exhaust gases which may be reducing gases. Alternatively, the enclosure may be sealed against ingress of oxygen containing atmosphere during operation of the strip caster. The oxygen content of the atmosphere within the enclosure is then reduced during an initial phase of casting by allowing oxidation of the strip to extract oxygen from the sealed enclosure as disclosed in U.S. Pat. Nos. 5,762,126 and 5,960,855.

Cast strip produced by twin roll caster is generally hot rolled in a hot rolling mill after the strip emerges from the caster to shape the thin strip. It is generally understood that to cast strip with acceptable shape, the hot rolling mill is used in connection with a twin roll caster is to provide the desired cross-sectional profile to the cast strip. Still, a surface roughness of 6 to 8 microns Ra with surface micro-cracking was common for cast strip emerging from the hot rolling mill while casting at a standard casting speed of 80 m/min and 16% reduction of the strip by the hot rolling mill. FIG. 1 is a micrograph showing typical surface roughness of such cast strip emerging from a hot rolling mill in-line with a twin roll caster. With the direction of rolling from left to right, the micrograph shows pronounced lapping on the strip surface (20 to 30 μm deep). The reason or reasons for this surface roughness may be shearing at the strip surface caused by welding of the strip to the work roll surface, imprinting of the texture of the work roll surface onto the surface of the strip, and/or other factors. Moreover, micro-cracking on the surface of the cast strip was a problem. It was possible to reduce the casting speed and the heat rate of the strip to reduce microcracking, but it was uneconomical to reproduce these conditions during production.

The microstructure of hot strip mill products is essentially 100% equiaxed ferrite. However, in making a cast strip with a twin roll caster, previous experience was that microstructure was coarse grains of polygonal ferrite, acicular ferrite, and Widmanstatten. It was typical that the microstructure was 30-60% polygonal ferrite, 70-40% Widmanstatten and acicular ferrite. With this microstructure, the typical surface roughness was 4-7 microns Ra.

A thin cast strip is provided having at least one microstructure selected from the group consisting of polygonal ferrite, acicular ferrite, Widmanstatten, bainite and martinsite, a surface roughness of less than 1.5 microns Ra and a scale thickness of less than about 10 microns made by the steps comprising:

a. assembling a twin roll caster having laterally positioned caster rolls forming a nip between them and a hot rolling mill having work rolls and back-up rolls adjacent the twin roll caster, b. forming a thin cast strip from the nip between the casting rolls of the twin roll caster, c. applying a mixture of water and oil on the back-up rolls of the hot rolling mill, d. passing the thin cast strip at a temperature of less than 1100° C. through the hot rolling mill while the mixture of oil and water is applied to the work rolls, and e. shrouding the thin cast strip from the casting rolls through the hot rolling mill in an atmosphere of less than 5% oxygen forming a cast strip having at least one microstructure selected from the group consisting of polygonal ferrite, acicular ferrite, Widmanstatten, bainite and martinsite, a surface roughness of less than 1.5 microns Ra, and a scale thickness of less than about 10 microns.

A thin cast strip may have a surface roughness less than 1.0 microns Ra or less than 0.7 or 0.5 microns Ra. The thin cast strip may have a scale thickness less than 7 or 4 microns. The cast strip may be passed through the hot rolling mill at a temperature less than 1050° C. while a mixture of oil and water is applied to the back-up rolls. The mixture of oil and water may be applied by spraying the upstream and/or low stream surfaces of the upper and/or lower back-up rolls. The mixture of oil and water may be less than 5% oil to form a thin cast strip with a low surface roughness of less than 1.5 microns Ra.

BRIEF DESCRIPTION OF THE DRAWINGS

The operation of an illustrative twin roll casting plant in accordance with the present invention is described with reference to the accompanying drawings, in which.

DESCRIPTION OF THE PREFERRED EMBODIMENTS

Figure 1:
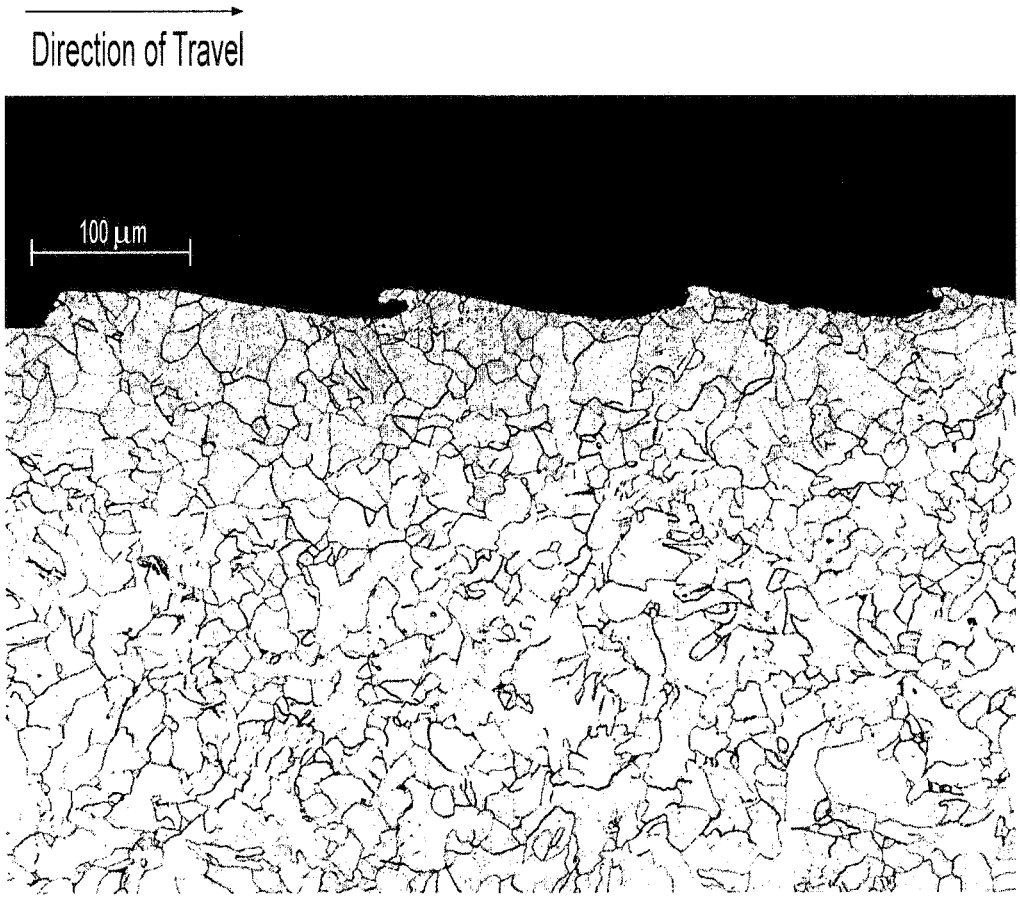
FIG. 1 is a micrograph showing typical surface roughness of a cast strip after hot rolling.

The illustrated casting and rolling installation comprises a twin-roll caster denoted generally by 11 which produces thin cast steel strip 12 which passes into a transient path across a guide table 13 to a pinch roll stand 14. After exiting the pinch roll stand 14, thin cast strip 12 passes into and through hot rolling mill 15 comprised of back-up rolls 16 and upper and lower work rolls 16A and 16B, where the thickness of the strip reduced. The strip 12, upon exiting the rolling mill 15, passes onto a run out table 17 where it may be forced cooled by water jets 18, and then through pinch roll stand 20 comprising a pair of pinch rolls 20A and to a coiler 19.

Twin-roll caster 11 comprises a main machine frame which supports a pair of laterally positioned casting rolls 22 having casting surfaces 22A and forming a nip between them. Molten metal is supplied during a casting campaign from a ladle (not shown) to a tundish 23, through a refractory shroud to a removable tundish 25 (also called distributor vessel or transition piece), and then through a metal delivery nozzle 28 (also called a core nozzle) between the casting rolls 22 above the nip.

Molten steel is introduced into removable tundish 25 from tundish 23 via an outlet of the refractory shroud. The tundish 23 is fitted with a stopper rod and a slide gate valve 34 to selectively open and close the outlet of the shroud 32 and effectively control the flow of molten metal from the tundish 23 to the caster. The molten metal flows from removable tundish 25 through an outlet and optionally to and through the delivery nozzle 28.

Molten metal thus delivered to the casting rolls 22 forms a casting pool above the nip supported by casting roll surfaces 22A. This casting pool is confined at the ends of the rolls by a pair of side dams or plates 26, which are applied to the ends of the rolls by a pair of thrusters (not shown) comprising hydraulic cylinder units connected to the side dams. The upper surface of the casting pool (generally referred to as the "meniscus" level) may rise above the lower end of the delivery nozzle 28 so that the lower end of the deliver nozzle is immersed within the casting pool.

Casting rolls 22 are internally water cooled by coolant supply (not shown) and driven in counter rotational direction by drives (not shown) so that shells solidify on the moving casting roll surfaces and are brought together at the nip to produce the thin cast strip 12, which is delivered downwardly from the nip between the casting rolls.

Below the twin roll caster 11, the cast steel strip 12 passes within a sealed enclosure 10 to the guide table 13, which guides the strip to a pinch roll stand 14 through which it exits sealed enclosure 10. The seal of the enclosure 10 may not be complete, but is appropriate to allow control of the atmosphere within the enclosure and access of oxygen to the cast strip within the enclosure as hereinafter described. After exiting the sealed enclosure 10, the strip may pass through further sealed enclosures after the pinch roll stand 14, including the hot rolling mill 15.

Enclosure 10 is formed by a number of separate wall sections that fit together at various seal connections to form a continuous enclosure wall. These sections comprise a first wall section 41 at the twin roll caster to enclose the casting rolls 22, and a wall enclosure 42 extending downwardly beneath first wall section 41 to form an opening that is in sealing engagement with the upper edges of a scrap box receptacle 40. A seal 43 between the scrap box receptacle 40 and the enclosure wall 42 may be formed by a knife and sand seal around the opening in enclosure wall 42, which can be established and broken by vertical movement of the scrap box receptacle 40 relative to enclosure wall 42. Seal 43 is formed by raising the scrap box receptacle 40 to cause the knife flange to penetrate the sand in the channel to establish the seal.

This seal 43 can be broken by lowering the scrap box receptacle 40 from its operative position, preparatory to movement away from the caster to a scrap discharge position (not shown). Scrap box receptacle 40 is mounted on a carriage 45 fitted with wheels 46 which run on rails 47, whereby the scrap box receptacle can be moved to the scrap discharge position. Carriage 45 is fitted with a set of powered screw jacks 51 operable to lift the scrap box receptacle 40 from a lowered position, where it is spaced from the enclosure wall 42, to a raised position where the knife flange penetrates the sand to form seal 43 between the two.

Sealed enclosure 10 further may have a third wall section disposed 61 about the guide table 13 and connected to the frame of pinch roll stand 14, which includes a pair of pinch rolls 50. The third wall section disposed 61 of enclosure 10 is sealed by sliding seals.

Most of the enclosure wall sections 41, 42 and 61 may be lined with water cooled panels. Also, scrap box receptacle 40 may be lined with water cooled panels or with a castable refractory lining. In this way, the complete enclosure 10 is sealed prior to a casting operation, thereby limiting access of oxygen to thin cast strip 12, as it passes from the casting rolls 22 through the pinch roll stand 14 and the hot rolling mill 15. Initially the strip can take up all of the oxygen from enclosure 10 space by forming heavy scale on an initial section of the strip. However, the sealing enclosure 10 limits ingress of oxygen into the enclosure from the surrounding atmosphere to below the amount of oxygen that could be taken up by the strip. Thus, after an initial start-up period, the oxygen content in the enclosure 10 will remain depleted so limiting the availability of oxygen for oxidation of the strip 12. In this way, the formation of scale is controlled to a thickness less than 10 microns without the need to continuously feed a reducing or non-oxidizing gas into the enclosure. Of course, a reducing or non-oxidizing gas may be fed through the enclosure walls. However, in order to avoid the heavy scaling during the start-up period, the enclosure 10 can be purged immediately prior to the commencement of casting so as to reduce the initial oxygen level within enclosure 10, thereby reducing the time period for the oxygen level to stabilize in the enclosure as a result of the interaction of the oxygen in oxidizing the strip passing through it. Thus, illustratively, the enclosure may conveniently be purged with, for example, nitrogen gas. It has been found that reduction of the initial oxygen content to levels of less than 5% will limit the scaling of the strip at the exit from the enclosure 10 to about 10 microns to 17 microns even during the initial start-up phase. In an embodiment of the present invention, the thin cast steel strip has a scale thickness less than about 10 microns, or the scale thickness may be less than 7 or 4 microns, during continuous casting.

Figure 2:
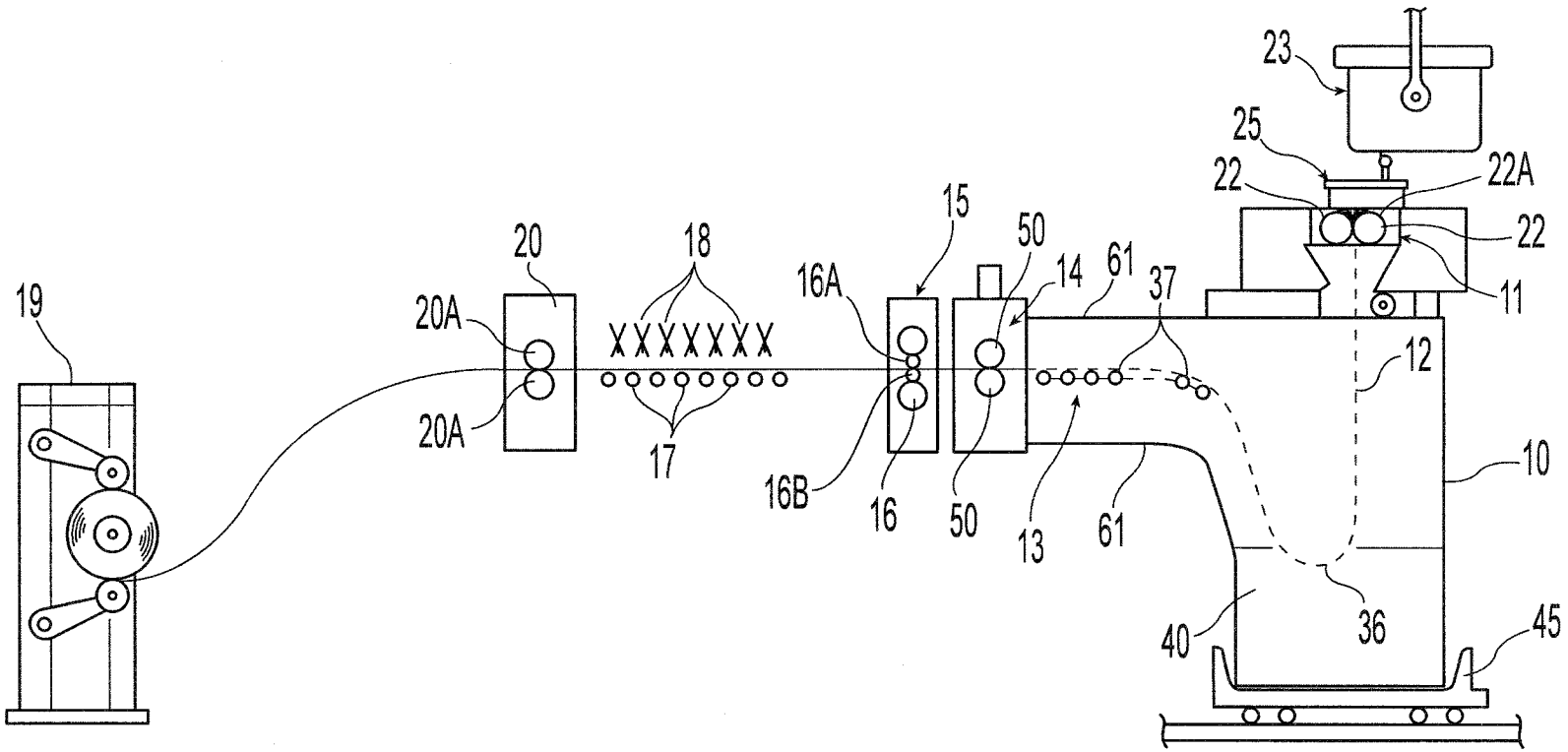
FIG. 2 is a schematic illustrating a thin strip casting plant having a hot rolling mill for controlling the shape of cast strip.
Figure 3:
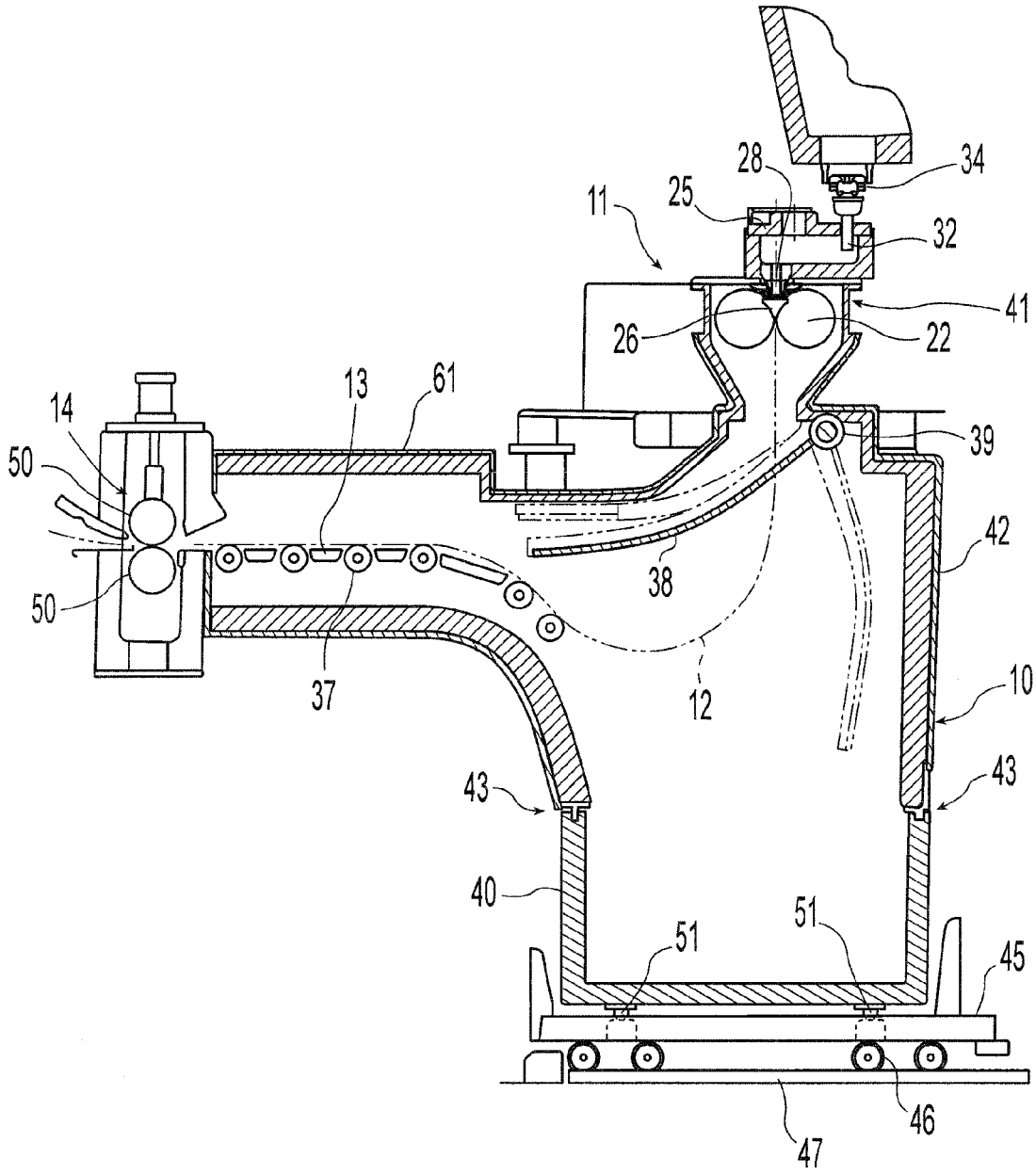
FIG. 3 is an enlarged cut-away side view of the caster of the thin strip casting plant of FIG. 2.

At the start of a casting campaign, a short length of imperfect strip is produced as the casting conditions stabilize. After continuous casting is established, the casting rolls 22 are moved apart slightly and then brought together again to cause this lead end of the strip to break away in the manner described in Australian Patent 646,981 and U.S. Pat. No. 5,287,912, to form a clean head end of the following thin cast strip 12. The imperfect material drops into scrap box receptacle 40 located beneath caster 11, and at this time swinging apron 38, which normally hangs downwardly from a pivot 39 to one side of the caster as shown in FIG. 3, is swung across the caster outlet to guide the clean end of thin cast strip 12 onto the guide table 13 where the strip is fed to the pinch roll stand 14. Apron 38 is then retracted back to its hanging position as shown in FIG. 3 to allow the strip 12 to hang in a loop 36 beneath the caster as shown in FIGS. 2 and 3 before the strip passes onto the guide table 13. The guide table 13 comprises a series of strip support rolls 37 to support the strip before it passes to the pinch roll stand 14. The rolls 37 are disposed in an array extending from the pinch roll stand 14 backwardly beneath the caster and curve downwardly to smoothly receive and guide the strip from the loop 36.

The twin-roll caster may be of a kind which is illustrated and described in detail in U.S. Pat. Nos. 5,184,668 and 5,277,243, or 5,488,988. Reference may be made to these patents for construction details, which are no part of the present invention.

Pinch roll stand 14 comprises a pair of pinch rolls 50 reactive to tension applied by the hot rolling mill 15. Accordingly, the strip is able to hang in the loop 36 as it passes from the casting rolls 22 to the guide table 13 and into the pinch roll stand 14. The pinch rolls 50 thus provides a tension barrier between the freely hanging loop and tension on the strip downstream of the processing line. The pinch rolls 50 also stabilize the position of the strip on the feed table 13, feeding the strip into hot rolling mill 15.

Figure 4A:
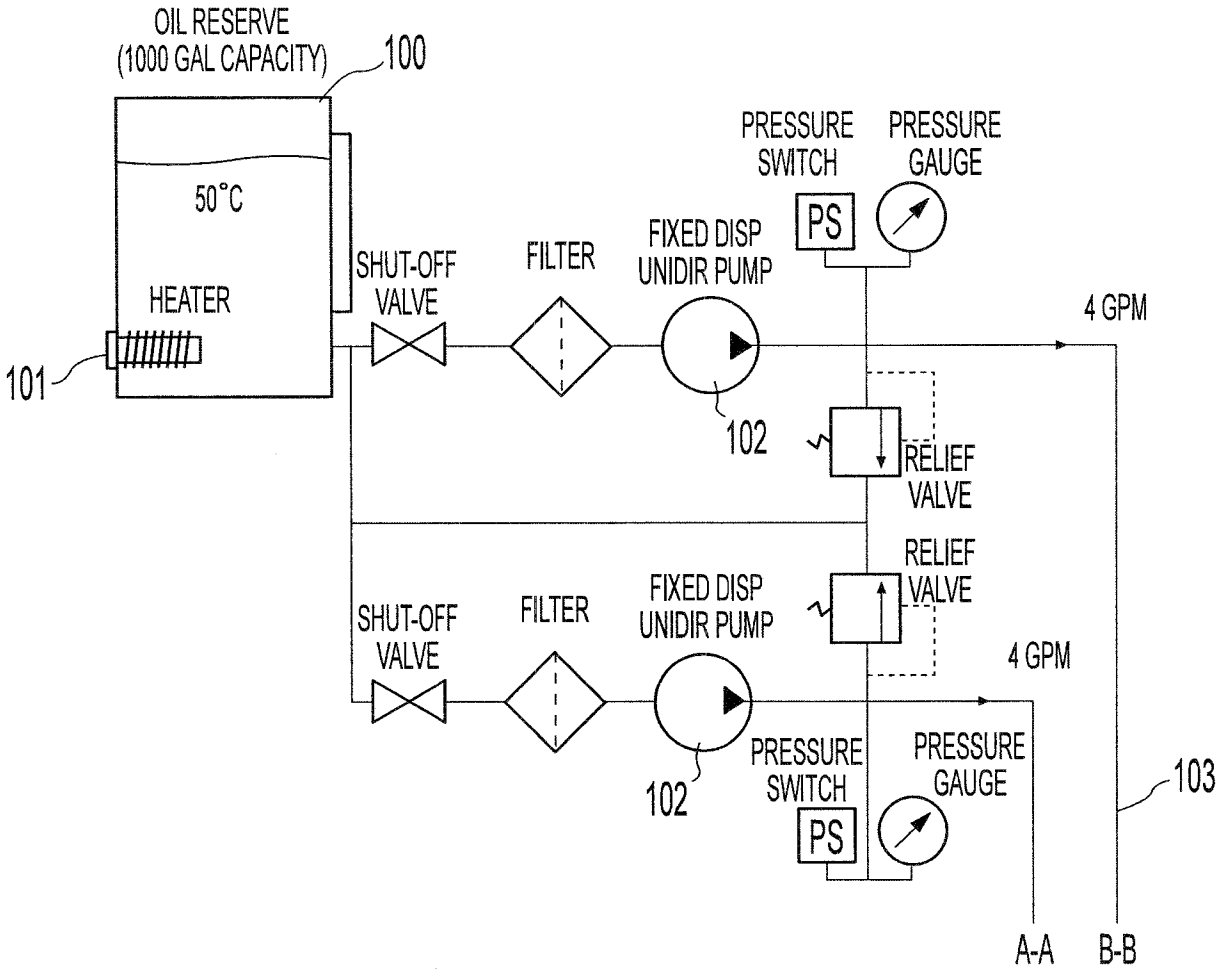
FIGS. 4A and 4B are a schematic diagram showing a system for the application of an oil and water mixture to the rolls of a hot rolling mill.
Figure 4B:
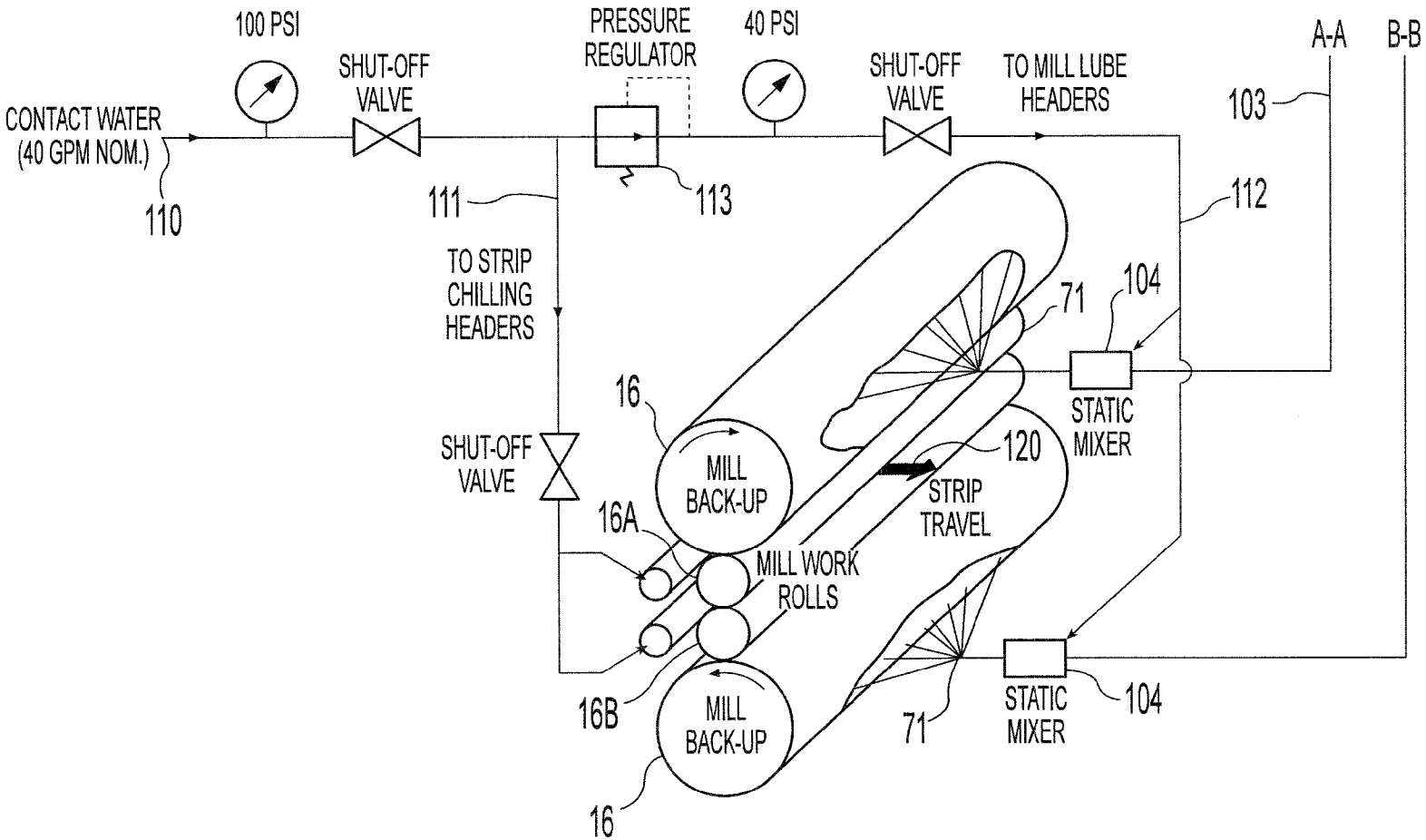

From the pinch roll stand 14, the thin cast strip 12 is delivered to the hot rolling mill 15 comprised of upper work roll 16A and lower roll 16B. As shown in FIG. 4, a preferred embodiment of the present invention comprises spraying a mixture of water and oil on the downstream surfaces of upper and/or lower back-up rolls 16. An oil reservoir 100 is provided with a heater 101 to maintain the oil at approximately 50° C., but heating is not necessary. The heated oil is transferred through oil transfer lines 103 by fixed displacement pumps 102 to static mixers 104 where the heated oil is mixed with water.

Water is supplied from a source 110 to water strip chilling headers 111 and to mill rolls supply lines 112. A first portion of the water is supplied to spray headers 18 to supply cooling water to cool the hot strip 12 after exiting the hot rolling mill 15. Typically, the water pressure is reduced through pressure regulator 113 to about 40 psi. Between about 10 and 30 gpm of water is supplied to each static mixer 104 where the water is mixed with about 4 gph of heated oil.

The mixed oil and water is then applied to the downstream surfaces (the direction of travel of the thin cast steel strip 12 is shown by arrow 120) of upper and/or lower back-up rolls 16 through oil-water nozzles 71. Alternately, the oil-water mixture may be applied to the upstream or downstream surfaces of the upper and/or lower back-up rolls 16.

Preferably, the temperature of the thin cast steel strip 12 in the hot rolling mill 15 is less than 1100° C., and more preferably less than 1050° C., and most preferably less than 900° C. Also, preferably, the temperature of the thin cast steel strip in the hot rolling mill 15 is above 400° C.

The static mixers 104 are standard conventionally available devices. Other forms of mixers may be used provided they are capable of good mixing of the oil and water.

In one embodiment, the oil-water mixture is delivered at between 5 and 30 gpm at 40 psi to the upper and lower back-up rolls 16. Typically the oil-water mixture is delivered to the back-up rolls in this embodiment at about 10 to 20 gpm, with 15 gpm a reasonable setting. The oil-water mixture may comprise less than 5% oil, and in one embodiment comprises 4 parts oil and between 600 parts to 1800 parts water by volume. The oil may be less than 2% or 1% of the mixture. The oil is provided to be mixed with the water generally at less than 15 gph.

Figure 5:
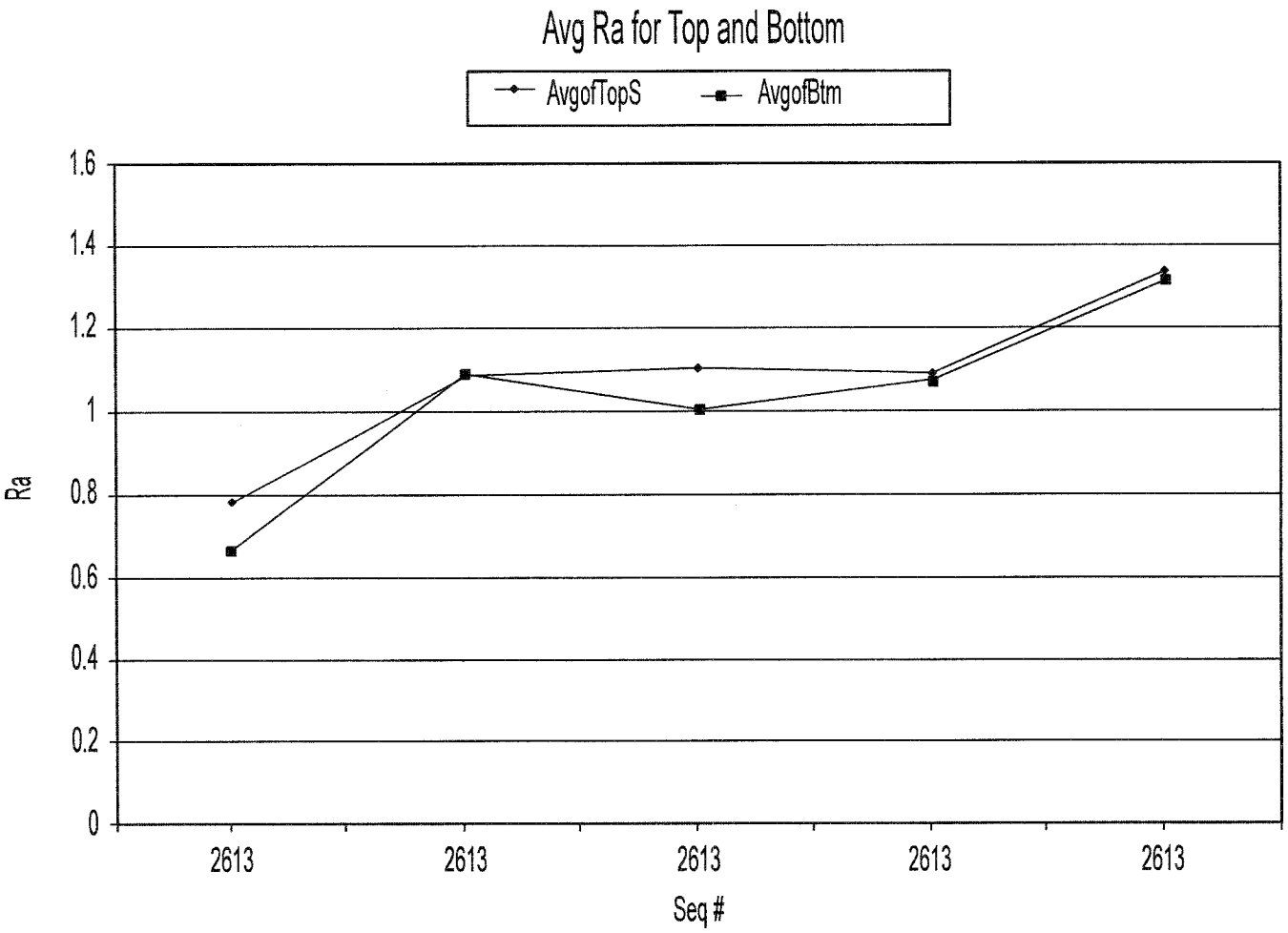
FIG. 5 is a diagram showing the Average Surface Roughness for Thin Cast Steel Strip, Sequence 2613, made using the present invention.

FIG. 5 shows the Average Surface Roughness (Ra) in microns for thin cast strip steel strip 12 produced using the present invention. As can be seen in FIG. 5, the Average Surface Roughness is noticeably lower, about 0.66 to about 1.5 microns with the addition of an oil-water mixture as described above.

In one embodiment, the present invention comprises producing thin cast steel strip using the oil-water application described above to produce thin cast steel strip at a rate above 80 meters per minute.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A method of producing a thin cast steel strip having a surface roughness of less than 1.5 microns Ra, the method comprising:

a. introducing molten steel between a pair of casting rolls having a nip there between;

b. counter-rotating the casting rolls to form solidified metal shells on the surfaces of the casting rolls and to form an intermediate cast steel strip through the nip between the casting rolls from the solidified shells;

c. introducing the intermediate cast steel strip to a hot rolling mill having back-up rolls and work rolls with work surfaces forming a gap between the work rolls through which the intermediate cast steel strip is rolled;

d. applying a mixture of oil and water directly on the back-up rolls of the hot rolling mill, the mixture of oil and water being transferred from the back-up rolls to the work rolls through engagement of the back-up rolls and the work rolls; and e. rolling the intermediate cast steel strip between the work rolls having the mixture of oil and water thereon to produce the thin cast steel strip having a surface roughness of less than 1.5 microns Ra.

2. The method of claim 1, where the rate of production of the thin cast steel strip is above 80 meters per minute.

3. The method of claim 1, where the intermediate cast steel strip is rolled through the hot rolling mill at a temperature below 1100° C.

4. The method of claim 1, where the intermediate cast steel strip is rolled through the hot rolling mill at a temperature below 1050° C.

5. The method of claim 1, where the intermediate cast steel strip is rolled through the hot rolling mill at a temperature below 900° C.

6. The method of claim 1, where the mixture of oil and water is applied directly on the back-up rolls at a rate between 10 and 30 gallons per minute.

7. The method of claim 1, where the surface roughness of the thin cast steel strip is below 1.0 microns Ra.

8. The method of claim 7, where the rate of production of the thin cast steel strip is above 80 meters per minute.

9. The method of claim 7, where the intermediate cast steel strip is rolled through the hot rolling mill at a temperature below 1100° C.

10. The method of claim 7, where the intermediate cast steel strip is rolled through the hot rolling mill at a temperature below 1050° C.

11. The method of claim 7, where the intermediate cast steel strip is rolled through the hot rolling mill at a temperature below 900° C.

12. The method of claim 7, where the mixture of oil and water is applied directly on the back-up rolls at a rate between 10 and 30 gallons per minute.

13. The method of claim 1, where the surface roughness of the thin cast steel strip is below 0.7 microns Ra.

14. The method of claim 13, where the rate of production of the thin cast steel strip is above 80 meters per minute.

15. The method of claim 13, where the intermediate cast steel strip is rolled through the hot rolling mill at a temperature below 1100° C.

16. The method of claim 13, where the intermediate cast steel strip is rolled through the hot rolling mill at a temperature below 1050° C.

17. The method of claim 13, where the intermediate cast steel strip is rolled through the hot rolling mill at a temperature below 900° C.

18. The method of claim 13, where the mixture of oil and water is applied directly on the back-up rolls at a rate between 10 and 30 gallons per minute.

19. The method of claim 1, where the surface roughness of the thin cast steel strip is below 0.5 microns Ra.

20. The method of claim 19, where the rate of production of the thin cast steel strip is above 80 meters per minute.

21. The method of claim 19, where the intermediate cast steel strip is rolled through the hot rolling mill at a temperature below 1100° C.

22. The method of claim 19, where the intermediate cast steel strip is rolled through the hot rolling mill at a temperature below 1050° C.

23. The method of claim 19, where the intermediate cast steel strip is rolled through the hot rolling mill at a temperature below 900° C.

24. The method of claim 19, where the mixture of oil and water is applied directly on the back-up rolls at a rate between 10 and 30 gallons per minute.

25. The method of claim 1, where the mixture of oil and water is applied directly on the back-up rolls using a plurality of spray nozzles positioned upstream of the work rolls.

26. The method of claim 1, where the mixture of oil and water is applied directly on downstream surfaces of the back-up rolls.

27. The method of claim 1, where the mixture of oil and water is applied directly on upstream surfaces of the back-up rolls.

28. The method of claim 1, where the mixture of oil and water is less than 5% oil.

29. The method of claim 1, where the thin cast steel strip has a surface scale thickness of less than about 10 microns.

30. The method of claim 1, where the thin cast steel strip has a surface scale thickness of less than about 7 microns.

31. The method of claim 1, where the thin cast steel strip has a surface scale thickness of less than about 4 microns.

32. The method of claim 1, where the thin cast steel strip has at least one microstructure selected from the group consisting of polygonal ferrite, acicular ferrite, Widmanstatten, bainite and martensite.

33. The method of claim 1, further comprising shrouding the intermediate cast steel strip from the casting rolls through the hot rolling mill in an atmosphere containing less than 5% oxygen.

* * * * *